United States Patent [19]

Motz et al.

[11] 4,010,905

[45] Mar. 8, 1977

[54] LINER SEGMENT FOR USE IN CONE CRUSHERS AND THE LIKE

[75] Inventors: Jerome C. Motz, Milwaukee; Robert J. Pokora, Cudahy, both of Wis.

[73] Assignee: Rexnord Inc., Milwaukee, Wis.

[22] Filed: Mar. 25, 1975

[21] Appl. No.: 561,793

[52] U.S. Cl. ..... 241/295; 241/207; 241/299

[51] Int. Cl.[2] ..... B02C 2/04

[58] Field of Search ..... 241/207, 294, 295, 299

[56] References Cited

UNITED STATES PATENTS

| | | | |
|---|---|---|---|
| 2,970,775 | 2/1961 | Chapman | 241/299 X |
| 3,142,449 | 7/1964 | Balmer | 241/207 X |
| 3,587,987 | 6/1971 | Motz | 241/294 |
| 3,612,421 | 10/1971 | Sabel | 241/295 X |
| 3,834,633 | 9/1974 | Dougall et al. | 241/295 |
| 3,840,192 | 10/1974 | Hendrickson | 241/207 |

*Primary Examiner*—Granville Y. Custer, Jr.
*Assistant Examiner*—Howard N. Goldberg
*Attorney, Agent, or Firm*—Kinzer, Plyer, Dorn & McEachran

[57] ABSTRACT

This is concerned with a liner segment which, when grouped with a plurality of like segments, is usable as a composite wearing element for lining the bowl in a cone crusher or the like. The liner segment may be considered to be generally upright, wider at the bottom than at the top, curvilinear between its sides so as to present a convex surface on one side and a concave surface on the other with integral mounting means projecting from the convex surface.

2 Claims, 3 Drawing Figures

LINER SEGMENT FOR USE IN CONE CRUSHERS AND THE LIKE

SUMMARY OF THE INVENTION

This is concerned with a liner or wearing element to be mounted in the bowl of a cone crusher and is more specifically concerned with a segment of a liner element constructed and arranged to be grouped with similar such segments or elements to effect a complete or composite liner for the bowl of the crusher.

A primary object of the invention is a wearing segment which is easy to mount in the bowl of a cone crusher and, when grouped with similar segments to make up a full or composite bowl, is much less expensive than a unitary bowl liner.

Another object is a wearing segment for use as a part of the liner for the bowl of a cone crusher which greatly simplifies manufacturing procedure and reduces the cost thereof.

Another object is a bowl liner segment which is intended for larger machines, for example a 10 foot cone crusher.

Another object is a bowl liner segment which permits the use of metals other than manganese steel, although manganese steel may be used.

Another object is a crushing liner segment constructed to extend from the top to the bottom of the crushing cavity, all in one piece.

Another object is a liner segment which reduces scrap in remelting as compared to a full conical shape which will distort when being cast and heat-treated.

Other objects will appear from time to time in the ensuing specification and drawings.

DESCRIPTION OF THE PREFERRED EMBODIMENT

Figure 1:
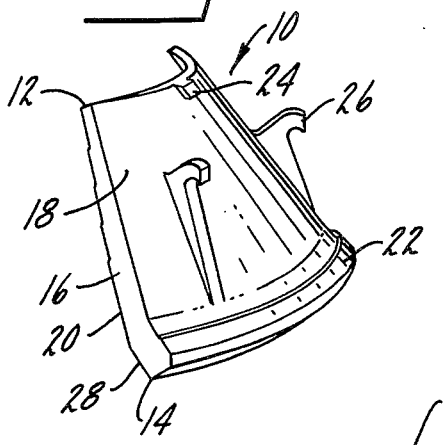
FIG. 1 is a perspective of a liner segment.

In FIG. 1 the liner segment has been shown in perspective and includes a body section or portion 10 which may be considered to be generally vertically disposed, for purposes of orientation, with a somewhat curvilinear upper edge 12 and a correspondingly curvilinear lower edge 14. It will be noted that the body is generally arcuate extending between side edges 16, each of which has been shown as disposed more or less on a vertical plane which, when the segment is mounted in a crusher, will pass through or be coincident with the vertical axis of the machine, although it might be otherwise. Thus the upper edge 12 is of less length or peripheral extent than the lower edge 14 so that the body takes on a somewhat upwardly and inwardly tapered appearance but is arced between the side edges 16 to provide a somewhat convex outer surface 18 and a corresponding concave inner surface 20.

Figure 2:
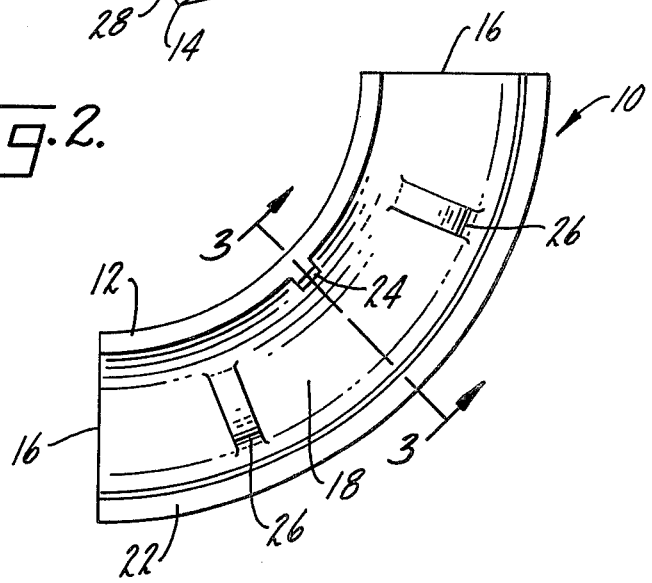
FIG. 2 is a top view of the segment in FIG. 1 on an enlarged scale.

It will be noted in FIG. 2 that the segment extends on the order of 90° from edge to edge so that when the segment is mounted in the bowl of a cone crusher, with three similar such segments abutted edge-to-edge, a full frusto-conical bowl liner will be provided with each segment being individually disposed and positioned.

And while the segment has been shown as extending roughly 90°, it should be understood that the segment may be longer or shorter so that more or less than four such segments are usable to make up or line the complete bowl.

The outer convex surface 18 of the liner is shaped to provide a lower frusto-conical bowl-engaging surface 22 which is raised or projected somewhat from surface 18. Surface 22 is intended to engage the frusto-conical surface of the bowl when the segment is mounted with the general area of surface 18 above it being out of contact with the bowl so that a backing may be poured between the segment and the bowl to provide a full and firm support for the wearing segment when crushing blows are delivered to the inner concave surface 20 by the crushing head of the machine. A similar projection 24 toward the top edge 12 extends outwardly from the convex surface 18 a distance roughly equal to the projection of peripheral surface 22, with 24 being limited in arcuate extent, as shown in FIG. 2, so that contact with the bowl will be made throughout the full 90° of surface 22 to give a more or less three point contact when the segment is mounted, although the projection may not be necessary.

The outer surface of the body element also has one or more mounting elements, shown in this case as hooks 26, which are integrally formed with the body element and extend a sufficient amount such that, when the segment is mounted in the crusher bowl, the hooks will extend through openings therein which are provided in a conventional manner with U-bolts or other types of mechanical devices being used to draw the hooks and segment up firmly against the bowl with a more or less axial upthrust or uplift.

Figure 3:
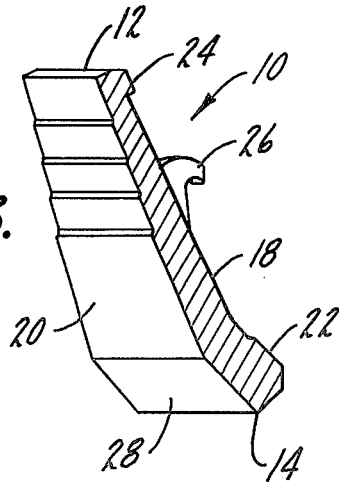
FIG. 3 is a section along line 3—3 of FIG. 2.

It will be noted that the segment is a good bit thicker toward the bottom than it is toward the top. The particular shaping of the concave inner surface 20 is shown in FIG. 3 as being stepped or divided into different crushing surfaces leading from the upper edge 12 down to what is referred to as the parallel zone 28 where final sizing takes place before the material leaves the zone adjacent to the lower edge 14. But the particular shape or shaping of the inner surface 20 may be according to any desired crushing cavity configuration.

The hooks are shown as disposed generally equidistant from the side edges 16 and generally midway between the side edges and the center of the segment which may be considered to correspond more or less to section line 3—3 in FIG. 2. Also, the positioning projection 24 is generally midway between the hooks 26 and therefore may be considered to be midway between the side edges 16. While only one positioning projection 24 is considered necessary, it should be understood that more than one may be used and any suitable spacing may be applied, if two or more are desired. Or a projection may not be necessary or desirable in all applications.

The use, operation and function of the invention are as follows:

One of the difficulties with making cone crushers of substantial size is that the bowl liner becomes quite large. If the bowl liner is made in one piece, meaning that it is cast all at once, in the case of quite large crushers, for example a 10-foot crusher, the bowl liner will have a large diameter on the order of 13 or 14 feet. A bowl liner of this size is extremely expensive to cast, very difficult to machine, and very expensive to heat treat. As a unitary piece, it will be out-of-round after casting and heat treating which will require that the centering surface that positions the liner in the bowl will have to be ground to quite accurate concentricity. Otherwise, a lobular or eccentric contact between the liner and bowl will mean that the liner will be difficult if not impossible to back with either zinc or plastic backing material and, at best, will not be fully supported and firmly backed all the way around.

The advantage of using segments or making a composite liner up out of a number of segments is that each of the segments will be much smaller so that the equipment required to cast a segment will be smaller and less expensive. Also, heat-treating a segment will be quite easy and the quenching that takes place will give a more uniform metallurgical microstructure as compared to a single frusto-conical liner which is difficult, at best, to heat treat. And the furnaces and quenching baths with a segment are greatly reduced in both size and expense. Since the segment is intended to be used in a cone crusher, a single segment, from top to bottom, will cover all stages or phases in the crushing operation of the machine, for maximum to minimum size. If a segment is bad, meaning that the casting procedure was faulty, it can be discarded and remelted without having to remelt a complete liner, which is difficult and expensive.

In certain situations if a particular segment for some reason could not be mounted by the user because, for example, it was improperly made, the customer could merely discard it and insert another segment. He would not be required to obtain a complete new liner. This would be particularly true if one of the segments was to break prematurely and if there had not been sufficient wear on the other segments, the operator would merely be required to substitute a new segment for the broken one and then continue operation.

By using segments, the contact surface 22, which centers or positions the segment in the crusher, may not have to be ground to accurate concentricity, although grinding may be desired. Rather, the segment can be mounted in the crusher in its as-cast condition and the out-of-round problem normally experienced with crusher liners is avoided because each segment is free to adjust itself to a proper position in the bowl of the machine. The same is true of the centering abutment or projection 24 at the top. And while a positioning projection 24 has been shown at the top, it should be understood that it may be positioned down somewhat toward or adjacent or generally on a level with the hooks, or slightly above them.

When a plurality of such segments are mounted in the machine, each will seek its own position and not cause misalignment of any of the others. The abutting edges or cracks between adjacent segments, as at 16, may be sealed with fiber glass or any other suitable sealing material or compound and then a backing material, be it zinc, plastic or what-have-you, may be poured in the top in a conventional manner.

There is an advantage to having two mounting hooks, although more or less may be used. But with two hooks, in the arrangement shown, a firm and full mounting will be obtained due to what might be considered or compared to a three-point contact provided by the centering button or projection 24 and the surface 22. But one hook or mounting lug, say midway between the edges 16, might be used. The segments may all be made the same and any four, if that's the number involved, may be grouped and used in a machine. They do not have to be made in matching sets. By using individual segments, as compared to one composite liner, the segments may be made in a large number of facilities and with inexpensive equipment.

Also, manganese steel has been indicated as a conventional material for making crusher liners. But it should be understood that other types of wear taking material may be used, for example a metal which has a very high resistance to wear, substantially higher than manganese steel, but is also a hard and brittle metal, for example pearlitic, carbidic, white cast iron, Martensitic, carbidic, chrome-nickel alloyed cast iron, sometimes known as Nihard, or like materials having a Brinell hardness number as high as 400 or more. Despite its brittleness, such a material may be used in a segment of the type disclosed here because the stresses created on one side of the bowl liner will not be transmitted peripherally around the crusher, but rather will be confined within a particular segment, thereby not resulting in fracture. Also, the segment might be made up of two components, the first being a backing member. which is tough and made of a high strength mild steel and the second being a hard somewhat brittle wear-taking metal which may have rather low impact resistance and is metallurgically bonded to the backing portion.

If only one hook 26 or mounting means is used, the positioning projections might be directly above it but not necessarily at the top edge 12. Regardless of the number of hooks or mounting devices used and regardless of the number or extent of the projections 24, it is believed that the projection should be above the general level of the hooks so that the segment will be pulled up and balanced between projection 24 and surface 22.

While the preferred form and several variations of the invention have been shown and suggested, suitable additional modifications, changes, substitutions and alterations may be made without departing from the invention's fundamental theme.

The embodiments of the invention in which an exclusive property or privilege is claimed are defined as follows:

1. A liner segment for use as a part of a composite liner assembly for lining the bowl in a cone crusher, the segment including a generally upright body portion in the form of a circumferential section of a frustoconical liner, the segment being of limited horizontal peripheral extent with a substantially greater horizontal dimension at the bottom than at the top, the side edges being defined by generally vertical surfaces adapted to oppose like surfaces on adjacent liner segments when mounted in the bowl of a crusher, the body being circumferentially curvilinear between the generally vertical side edge surfaces defining a somewhat convex outer surface to be positioned against the bowl of the crusher and a somewhat concave inner surface shaped and arranged to define a portion of the crushing cavity in the cone crusher, the segment having a maximum thickness at the bottom and diminishing in thickness toward the top, a peripherally continuous unitary lower bowl-engaging surface adjacent to and limited to the bottom edge of the segment projecting outwardly from the convex outer surface, and a unitary upper bowl-engaging projection adjacent the upper edge of the segment extending outwardly from the convex outer surface a distance generally equal to the distance of extension of the peripheral continuous lower surface, the upper projection extending a peripheral distance between the vertical surfaces which is substantially less than the peripheral extent of the upper edge between the vertical surface.

2. The structure of claim 1 further characterized by and including two peripherally spaced, symmetrically arranged mounting hooks projecting from the convex outer surface generally equidistant from the side edge surfaces for mounting the segment in the bowl of a cone crusher.

* * * * *

UNITED STATES PATENT OFFICE

CERTIFICATE OF CORRECTION

Patent No. 4,010,905 Dated March 8, 1977

Inventor(s) Jerome C. Motz etal.

It is certified that error appears in the above-identified patent and that said Letters Patent are hereby corrected as shown below:

On the cover sheet the illustrative Figure should appear as shown below:

Fig. 1.

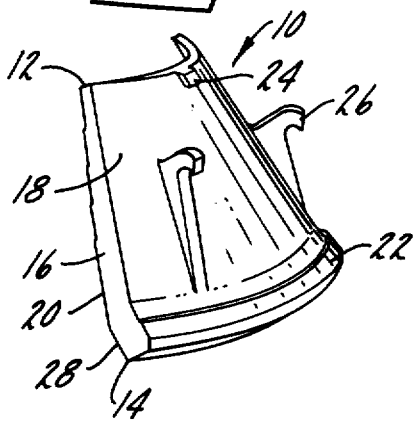

Signed and Sealed this

Tenth Day of May 1977

[SEAL]

*Attest:*

RUTH C. MASON
*Attesting Officer*

C. MARSHALL DANN
*Commissioner of Patents and Trademarks*